US010890038B2

(12) United States Patent
Gupta

(10) Patent No.: US 10,890,038 B2
(45) Date of Patent: Jan. 12, 2021

(54) DOUBLE LAYER RACKING BOARD AND METHODS OF USE

(71) Applicant: Nabors Drilling Technologies USA, Inc., Houston, TX (US)

(72) Inventor: Ashish Gupta, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/370,445

(22) Filed: Mar. 29, 2019

(65) Prior Publication Data

US 2020/0308916 A1 Oct. 1, 2020

(51) Int. Cl.
*E21B 19/15* (2006.01)

(52) U.S. Cl.
CPC ..... *E21B 19/15* (2013.01)

(58) Field of Classification Search
CPC ..... E21B 19/15; E21B 19/155; E21B 19/14; E21B 19/16; E21B 19/20
USPC ..... 414/22.51–22.71
See application file for complete search history.

(56) References Cited

U.S. PATENT DOCUMENTS 3,768,663 A * 10/1973 Turner, Jr. ..... E21B 19/14 211/70.4
4,850,439 A * 7/1989 Lund ..... E21B 19/20 175/52
7,802,636 B2 * 9/2010 Childers ..... E21B 19/155 175/52
2009/0053015 A1 * 2/2009 Zachariasen ..... E21B 19/14 414/22.66
2012/0201632 A1 * 8/2012 Yater ..... E21B 19/14 414/22.65
2016/0160586 A1 * 6/2016 Keogh ..... E21B 19/24 414/22.65
2017/0234088 A1 * 8/2017 Orr ..... E21B 3/02 166/380
2018/0058160 A1 * 3/2018 Magnuson ..... E21B 19/155

FOREIGN PATENT DOCUMENTS

WO WO 2015/175093 * 11/2015 ..... E21B 19/08

* cited by examiner

*Primary Examiner* — Lynn E Schwenning
(74) *Attorney, Agent, or Firm* — Haynes and Boone, LLP

(57) ABSTRACT

The systems, devices, and methods described herein relate to a double layer racking board on a land-based drilling rig. The double layer racking board may include a drill pipe racking board and a casing racking board. The drill pipe racking board may be positioned at a different height than the casing racking board, such than operator is able to comfortably access drill pipe stands and casing stands of different heights via the racking boards. The double layer racking board may allow for the performance of a first drilling operation involving drill pipe stands at the same time as the performance of a second drilling operation involving casing.

20 Claims, 12 Drawing Sheets

DOUBLE LAYER RACKING BOARD AND METHODS OF USE

TECHNICAL FIELD

The present disclosure is directed to systems, devices, and methods for the manipulation, assembly, moving, and detection of tubulars within a derrick or mast in oil and gas drilling systems. More specifically, the present disclosure is directed to systems and devices including a double layer racking board and methods for handing drill pipe and casing on a drilling rig.

BACKGROUND OF THE DISCLOSURE

The rise in cost for exploration and production of hydrocarbons has been a driving force for improved efficiencies in drilling operations. Current costs for the actual drilling of a well has increased over the past 10 years; gaining a greater percentage of the total cost of the well.

The efficiency of a particular drilling operation is impacted by the time required to manipulate, assemble, and break down drilling components such as drill pipe (forming a drill string) and casing. In drilling operations, casing is inserted into a borehole at periodic intervals as the borehole is drilled. Each time another stand of casing is lowered into the borehole, the drill string is tripped out of the borehole, and a stand of casing is assembled from casing tubulars for insertion. As the drill string is tripped out of the borehole it is broken down into stands and set aside, for example in a fingerboard. After the casing is inserted into the borehole, the drill string is reassembled and tripped back into the borehole.

Conventional casing operations do not occur until the drilling rig has completed tripping out of the hole. That is, currently drilling and casing operations cannot occur simultaneously on land-based mobile drilling rigs due to the limited size of the drill floor and use of a standard racking board for mobile rigs. The use of offline or safe zone stand building does not readily allow for use of both drill pipe and casing within the existing well floor.

Furthermore, differences in length between drill pipe and casing may cause problems with the single racking system, requiring adjustment of the height of the racking board during a drilling operation.

Recent inventions and development of automated racking operations for mobile rigs and small platform rigs open a new opportunity for increased efficiency in drilling operations. The present disclosure addresses one or more of these or other deficiencies in the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
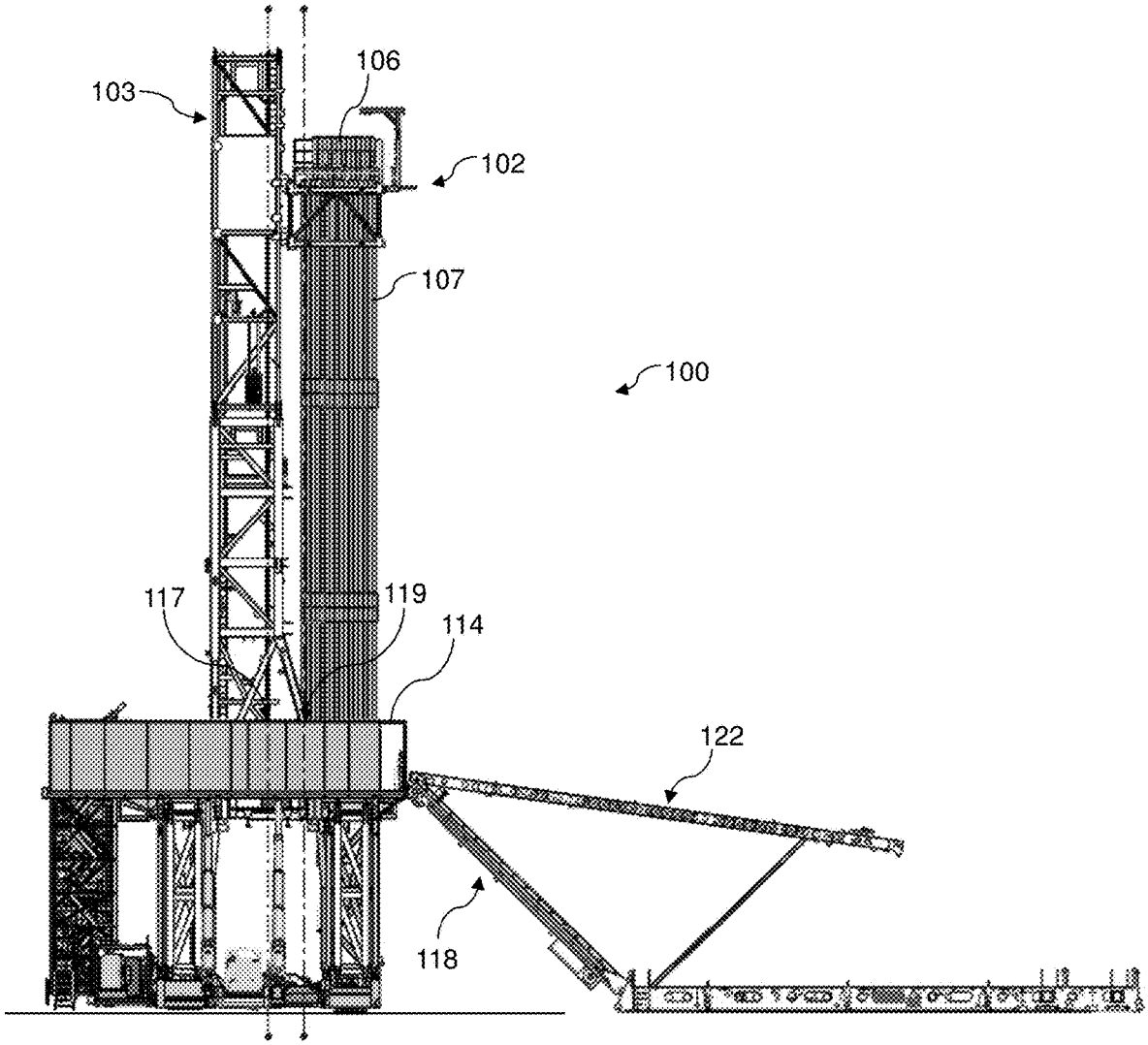
FIG. 1 is a schematic of an exemplary land-based drilling rig according to one or more aspects of the present disclosure.

It is to be understood that the following disclosure provides many different implementations, or examples, for implementing different features of various implementations. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various implementations and/or configurations discussed. Moreover, the formation of a first feature over or on a second feature in the description that follows may include implementations in which the first and second features are formed in direct contact, and may also include implementations in which additional features may be formed interposing the first and second features, such that the first and second features may not be in direct contact.

The systems, devices, and methods described herein relate to a drilling rig apparatus that includes a dual or double layer racking board. The double layer racking board may include a drill pipe racking board and a casing racking board. In some implementations, the drill pipe racking board and casing racking board are positioned at different levels to efficiently handle drill pipe and casing tubulars of different sizes. The double layer racking board may allow for the simultaneous performance of operations involving both drill pipe and casing, such as tripping in, tripping out, tubular stand make-up, tubular stand breakdown, casing stand make up, casing stand breakdown, or introducing casing stands to well center 117. The double layer racking board may improve efficiency of the drilling rig and lessen the physical requirements of derrick operators.

Figure 2:
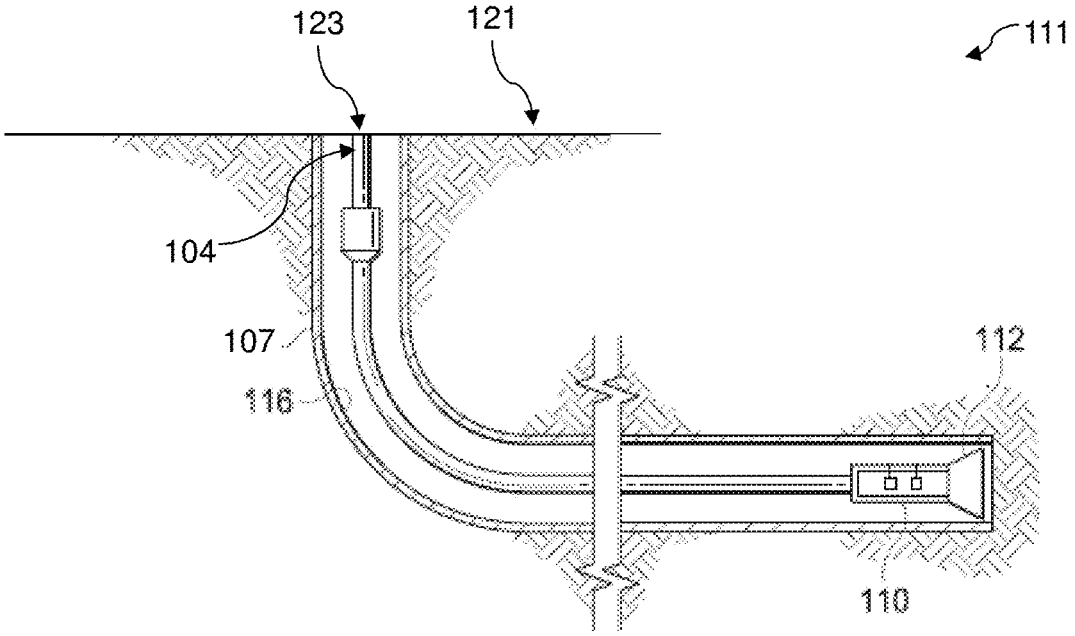
FIG. 2 is a diagram of an underground portion of the drilling rig according to one or more aspects of the present disclosure.

FIG. 1 is a schematic of a side view an exemplary drilling rig apparatus 100 according to one or more aspects of the present disclosure. In this implementation, the drilling rig includes a double layer racking board. 102. The double layer racking board 102 may be configured to support the manipulation, assembly, and disassembly of a drill pipe 106 and casing 107. The drill pipe 106 may be assembled into a drill string 104 (as shown in FIG. 2) that is connected to and rotated by a top drive (carried by the mast 103) and may terminate in a bottom hole assembly (BHA) 110, which includes a drill bit 112 (as shown in FIG. 2). In some implementations, the drill string 104 may include one or more subs or other components. The drill pipe 106 may include a plurality of tubular stands that are assembled on a drill floor 114 before being lowered into a wellbore 116 through a well center 117 in the drill floor 114. In some implementations, the drill floor 114 may be sized in a range of about 35×35 feet, although larger and smaller drill floors are contemplated. In some implementations, the drilling rig 100 may have a drill floor 114 sized less than approximately 1600 square feet. In other implementations, the drilling rig 100 may have a drill floor size of less than approximately 1200 square feet. In some implementations, the drilling rig 100 may be a mobile, land-based drilling rig.

In the implementation shown, the drill floor 114 may be raised above ground level, and may be accessible by a pair of catwalks 118 and 122. In some implementations, catwalks 118 and 122 connect to the drill floor 114 on the same side of the drill floor 114 and may allow users to introduce materials to the drill floor 114. For example, a first set of tubulars (e.g., drill pipe tubulars) may be introduced to or removed from the drill floor 114 via the first catwalk 118, and a second set of tubulars (e.g., casing tubulars) may be introduced to or removed from the drill floor 114 via the second catwalk 122.

The drilling rig may include a mousehole 119 in the drill floor 114 which may be used for assembling and disassembling drill pipe 106 and casing 107 at a location spaced apart from the well center 117 so as to not interfere with drilling at the well center 117 in the rig floor 114. In some implementations, the mousehole 119 is located above a shallow hole below the rig floor 114 that is offline or laterally displaced from the well-center 117, where individual tubulars may be assembled together into stands, e.g. a plurality, such as three tubulars together that are then racked into a racking board (such as the double layer racking board 102) for later use or storage. The double layer racking board 102 is described in greater detail below.

FIG. 2 shows a schematic view of a portion 111 of the drilling 100 of FIG. 1 as seen underground. The well center bore 123 is shown extending down from the surface 121 of the ground (extending through well center 117 show in FIG. 1). At periodic intervals during drilling, casing 107 may be introduced into the well center bore 123 to stabilize the structure of the bore hole. This may occur at any stage of drilling, including during vertical, curved, or horizontal sections. Casing 107 may be formed of large diameter tubulars that may be held in place with cement poured between the casing and the wellbore wall 116. The casing 107 may provide various benefits to the well center bore 123, such as preventing the wellbore wall 116 from collapse, providing support for high pressure introduction of fluid to the well center bore 123, and providing a smooth bore hole for the drill string 104 to navigate, which may be particularly important as the length of the well center bore 123 grows.

Figure 3A:
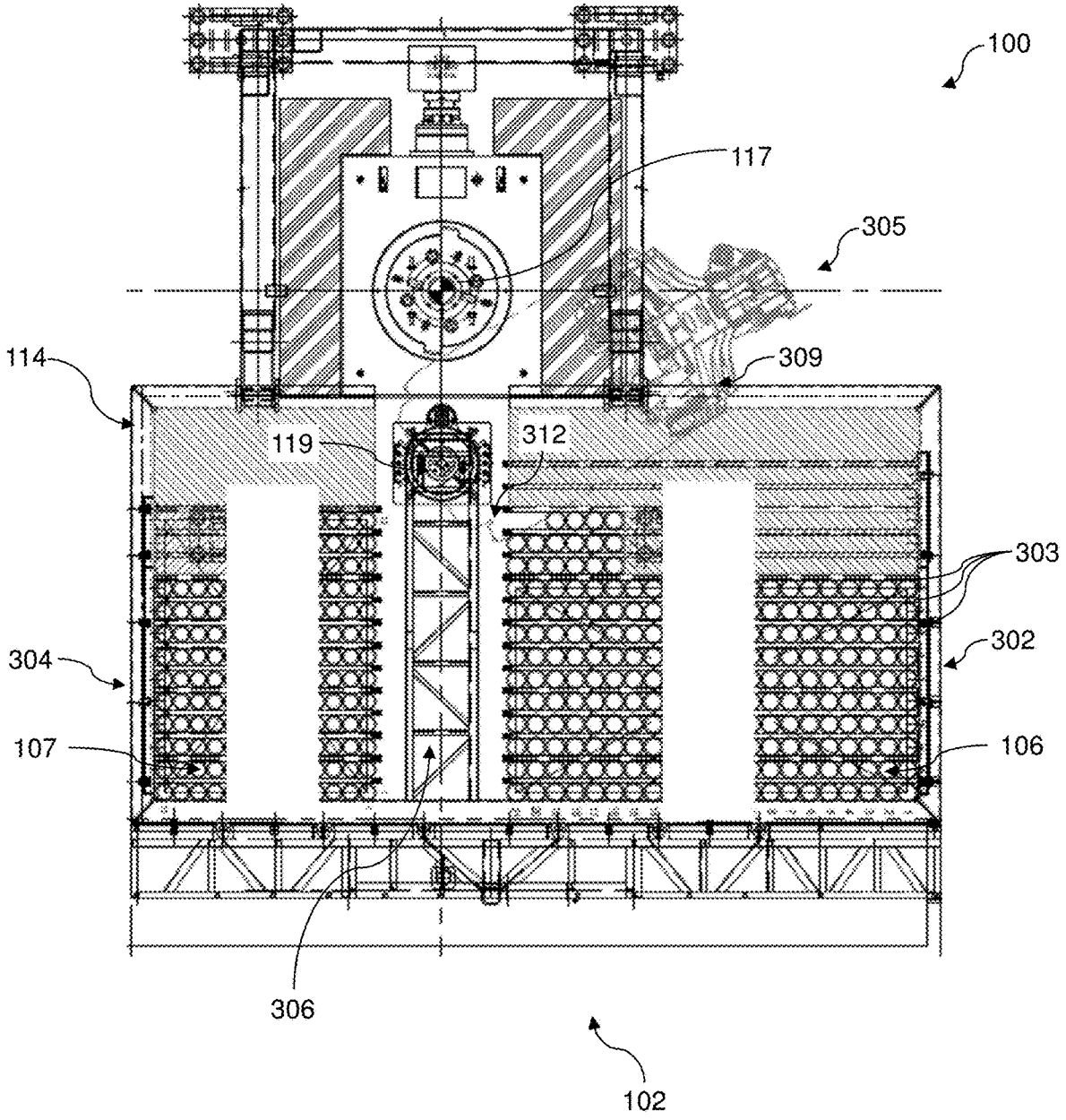
FIG. 3A is a top view showing the drilling rig according to one or more aspects of the present disclosure.

FIG. 3A shows a top cross-sectional view of an implementation of the drilling rig 100 which includes a double layer racking board 102 including a drill pipe racking board 302 and a casing racking board 304. The racking boards 302, 304 may include a number of fingers 303 configured to receive and support drill pipe 106 or casing 107 vertically disposed on drill floor 114. For example, the racking boards 302, 304 may be used to hold and store drill pipe 106 and casing 107 for later introduction to well center 117. In other examples, during disassembly of the drill pipe stands, stands may be introduced into the mousehole 119 so that the stands can be broken down into drill pipe tubulars. The drill pipe stand may then be lifted out of the mousehole 119 and introduced into the fingers 303 of the drill pipe rack 302 for later use or if breaking down, the tubulars may be removed from the drilling rig 100.

In some implementations, drill stands comprise three drill pipe tubulars with a length of about 27-32 feet, such that the drill stands have a length of about 81-90 feet. In some implementations, the drill stands have a length of about 93 feet. Other lengths of drill pipe 106 and stands are contemplated. Casing may also be assembled into stands which may include two casing tubulars 107. In some implementations, the casing 107 tubulars have a length of about 43-45 feet, such that the casing stands have a length about 86-90 feet. Other lengths of casing 107 and stands are contemplated. In some cases, the drill pipe racking board 302 and the casing racking board 304 are set at different heights to accommodate the different lengths of the drill stands and the casing stands. For example, the drill pipe racking board 302 may be placed at a first height A with respect to the drill floor 114 and the casing racking board 304 may be placed at a second height B with respect to the drill floor 114 that is less than the first height A. In some implementations, the first height A of the drill pipe racking board 302 is about from about 86 feet to 90 feet while the second height B of the casing racking board 304 is about 81 to 88 feet. In other implementations, the first height A of the drill pipe racking board 302 is up to about 93 feet while the second height B of the casing racking board 304 is up to about 90 feet. These heights represent an improvement from existing drilling rigs because it is safer and more comfortable for a derrick man to be able to push drill stands or casing stands at chest level without having to bend his back. The double layer racking board 102 allows easy access to both sets of stands without requiring the derrick man to reach or stoop for access. For example, the drill pipe racking board 302 and the casing racking board 304 may be connected with stairs or a ladder to facilitate access to the different levels.

The double layer racking board 102 may provide improved efficiency for a drilling rig as compared to existing drilling systems because it may allow for simultaneous racking of drill pipe 106 and casing 107 on the drilling rig 100. This may allow stands of drill pipe 106 or casing 107 to be assembled or disassembled at the same time as a drilling operation, such as tripping in or out, or running in casing. The capacity to make and rack casing stands while tripping out is performed may reduce casing running time by at least 30%. Furthermore, the double layer racking board may provide for reduction in the amount of time required to run casing to the bottom of the wellbore which in turn may reduce risks from other problems associated with the wellbore (such as ingress of material into the wellbore).

In some implementations, one or more diving boards 306 may be used to access the racking boards 302, 304. The diving boards 306 may be disposed between the drill pipe racking board 302 and the casing racking board 304. In some implementations, the one or more diving boards 306 are vertically movable relative to the double layer racking board 102 (as indicated by the dashed arrows in FIG. 6), such that a worker can access either of the drill pipe racking board 302 and the casing racking board 304 comfortably. In other implementations, diving boards 306 are disposed near both of the drill pipe racking board 302 and the casing racking board 304. In this case, the two diving boards 306 may be connected with an access point such as stair or a ladder.

A mousehole 119 in the drill floor 114 is also shown in FIG. 3A. The mousehole 119 is may be sized to allow drill pipe 106 and casing 107 to pass through. The mousehole 119 may be used in the assembly and disassembly of drill pipe 106 into drill pipe stands and the assembly and disassembly of casing 107 into casing stands. For example, during assembly of drill pipe stands, a drill pipe tubular 106 may be retrieved from the double layer racking board 102 and lowered into the mousehole 119 for connection to other drill pipe tubulars to create drill pipe stands. During assembly of casing stands, casing 107 may be retrieved from the double layer racking board 102 and lowered into the mousehole 119. Some implementations employ lifting equipment such as a racking device 305 to raise, lower, or manipulate the drill pipe 106 and casing 107. In some implementations, the racking device 305 may be an automatic racking device used to lift the drill pipe tubulars and stands into and out of the mousehole 119. In some implementations, the racking device 305 is a column racker that may have one or more arms that are operable to extend and retract and grasp drill pipe 106 and casing 107. The arms may be arranged to introduce or remove stands to the fingers 303 of the racking boards 302, 304 for presentation to well center 117, the v-door, or the mousehole 119. In some implementations, the arms may be able to extend away from racking device 305 to facilitate various actions, as described below. In some implementations, the racking device includes two arms, one arranged to grasp an upper portion or a top portion of a tubular or stand, and another one arranged to grasp a lower portion or bottom of a tubular or stand.

The drill floor 114 may include a setback area 312. The setback area 312 may provide an area for drill pipe 106 or casing 107 tubulars to be manipulated while being assembled or disassembled into stands, for example, by racking device 305. The racking device 305 may then place the drill pipe 106 or casing 107 stands in the drill pipe racking board 302 or casing racking board 304, respectively. In some implementations, the setback area 312 has sufficient capacity to rack drill pipe 106 and casing 107 simultaneously. This may occur for example, by building doubles of casing while drilling or disassembling the drill string while placing casing in the wellbore.

Figure 3B:
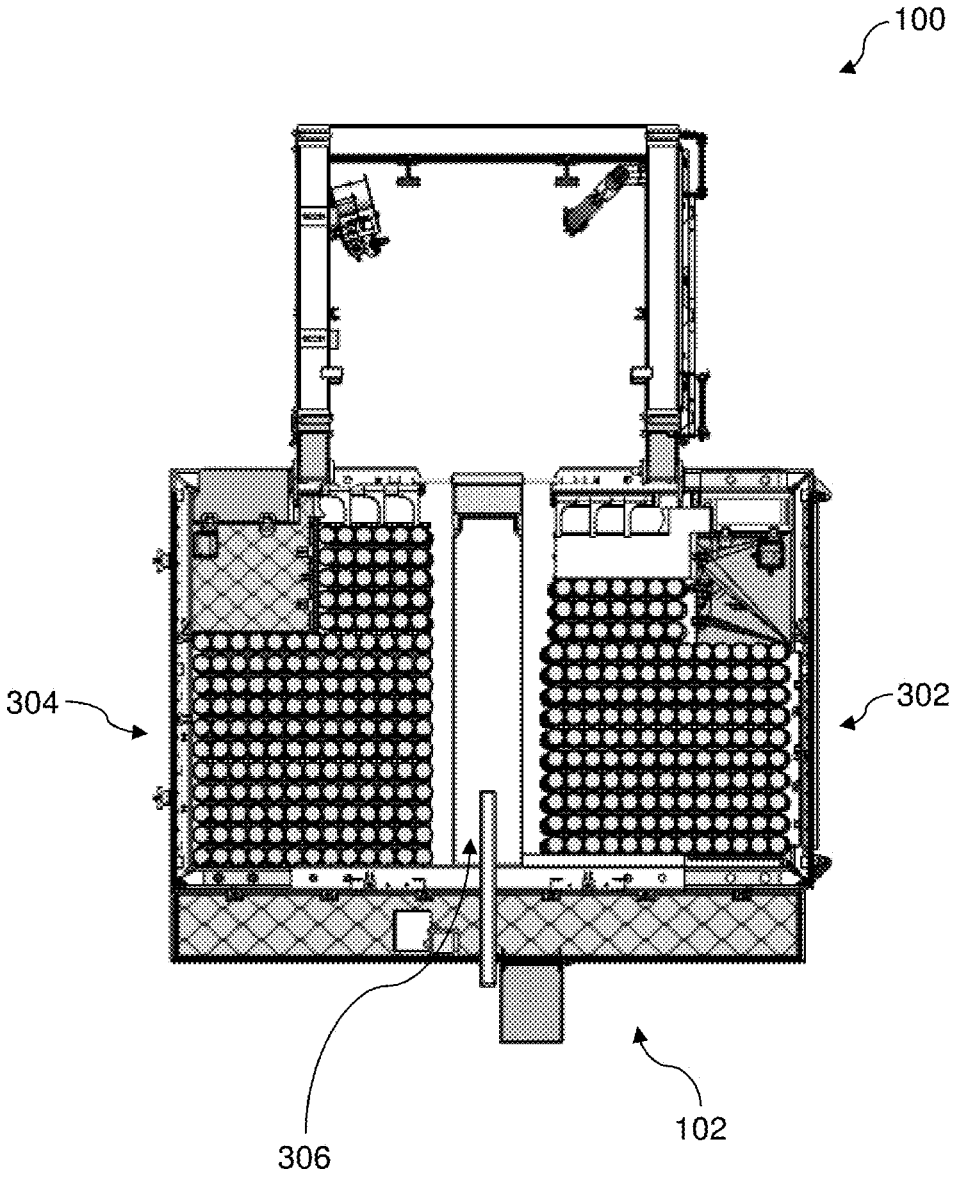
FIG. 3B is another top view showing the drilling rig according to one or more aspects of the present disclosure.

FIG. 3B shows a top cross-sectional view of another implementation of the drilling rig 100 which includes a double layer racking board 102 including a drill pipe racking board 302 and a casing racking board 304. In the example of FIG. 3B, the drill pipe racking board 302 has an area similar to that of the casing racking board 304. One or more ends of the drill pipe racking board 302 may also be substantially aligned with one or more ends of the casing racking board 304. In some implementations, the drill pipe racking board 302 and casing racking board 304 are disposed adjacent the diving board 306.

Figure 4:
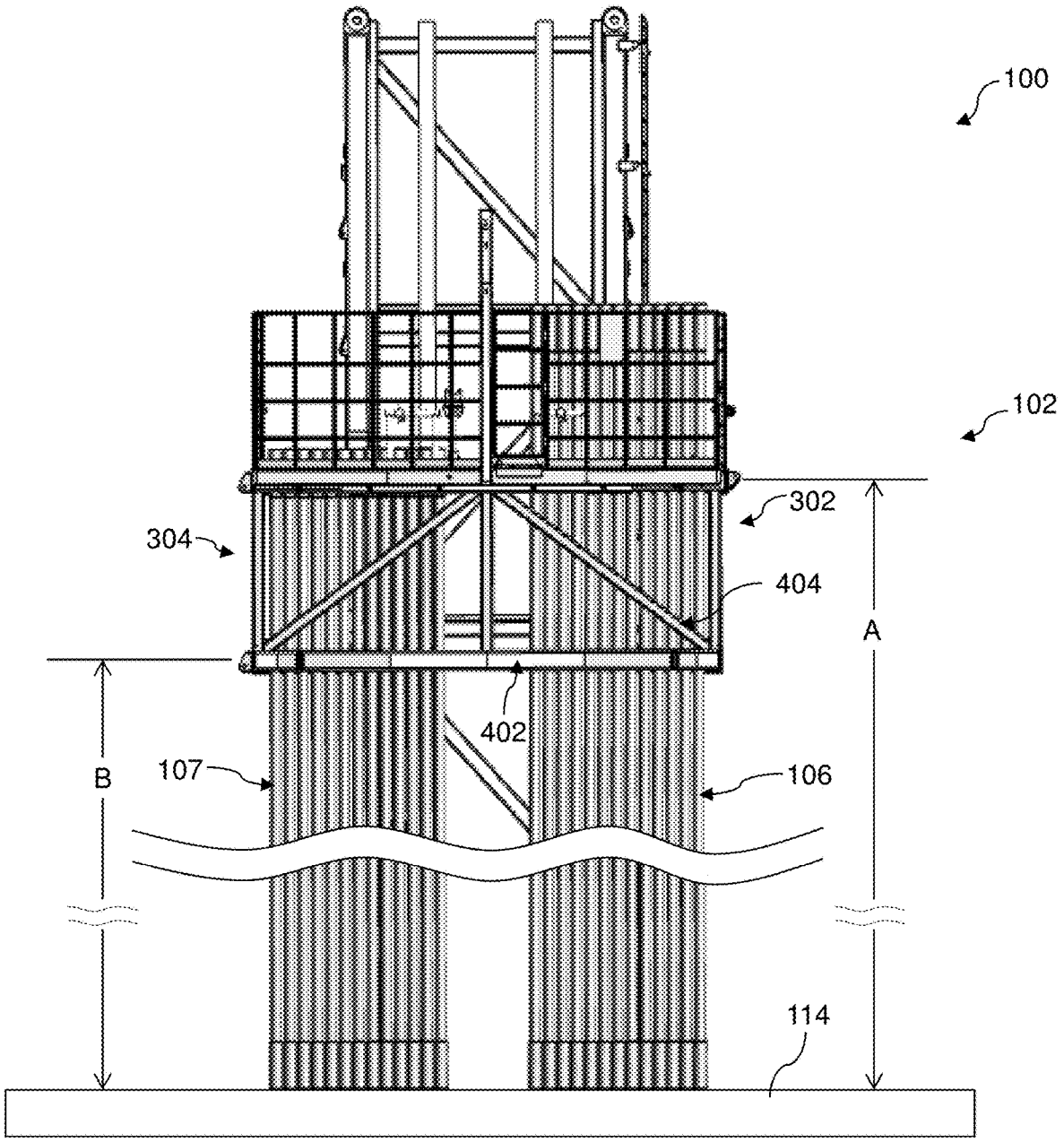
FIG. 4 is a front view of the drilling rig according to one or more aspects of the disclosure.

FIG. 4 shows a front view of the drilling rig 100 including a double layer racking board 102 with a drill pipe racking board 302 and a casing racking board 304. As shown in FIG. 4, the drill pipe racking board 302 and a casing racking board 304 may have different heights with respect to the base of the drilling rig 100 to accommodate drill pipe 106 and casing 107 stands of different heights. In some implementations, the drill pipe racking board 302 is structurally connected to the casing racking board 304. For example, a common support 402 may connect the drill pipe racking board 302 to the casing racking board 304. The drill pipe racking board 302 and casing racking board 304 may also be connected by one or more struts 404. In another implementation, the drill pipe racking board 302 and casing racking board 304 are cantilevered. For example, the drill pipe racking board 302 and casing racking board 304 may be independently attached to a common central support structure (such as the mast) on one or two ends. In yet another implementation, the drill pipe racking board 302 are independently connected to the drilling rig 100 and are not directly connected to each other.

Figure 5:
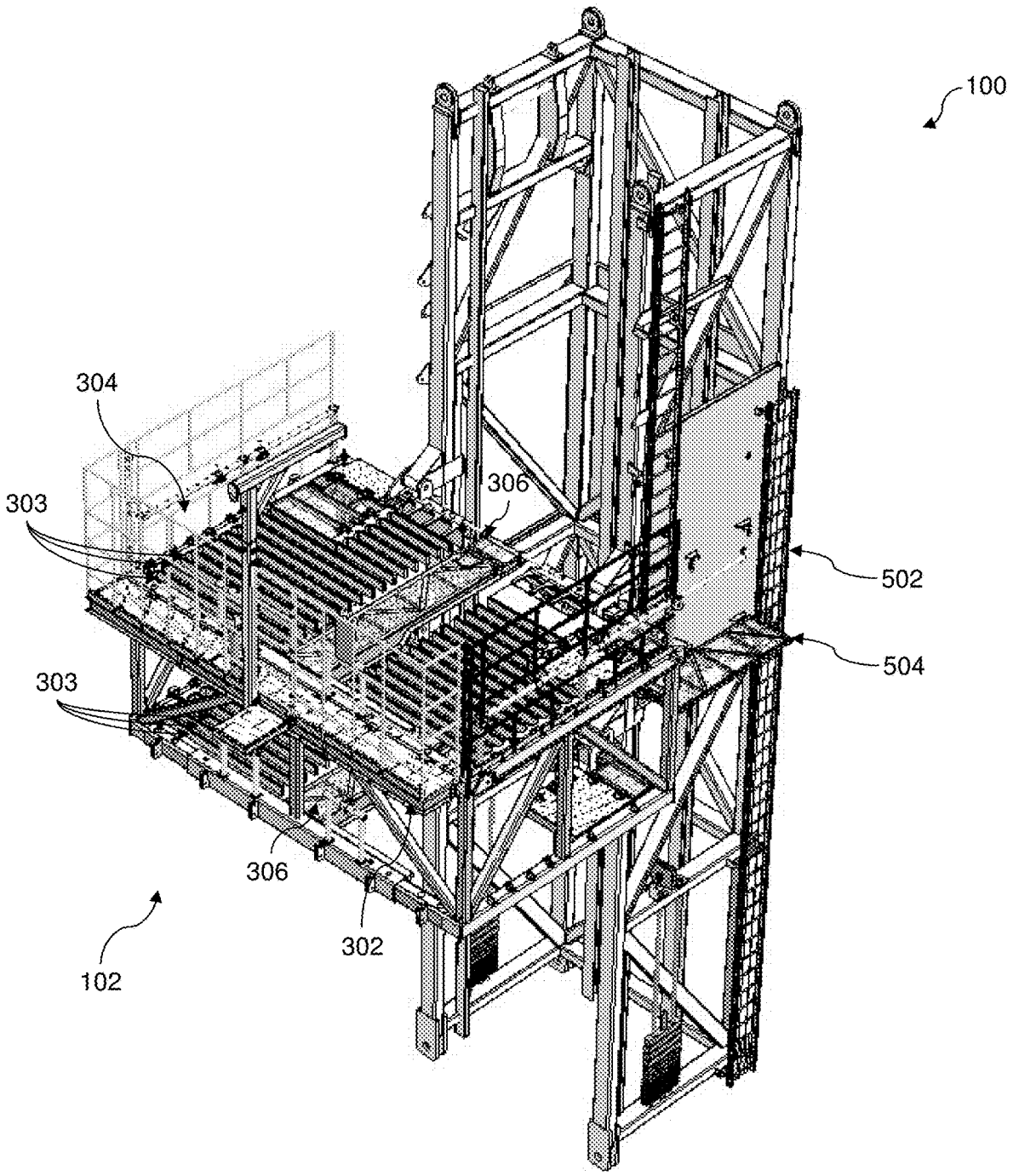
FIG. 5 is a perspective view of the drilling rig according to one or more aspects of the disclosure.

FIG. 5 shows a perspective view of the drilling rig 100 including the double layer racking board 102 without drill pipe 106 or casing 107. In some implementations, the drill pipe racking board 302 includes a single set of fingers 303 and casing racking board 304 includes two sets of fingers 303. For example, the casing racking board 304 may include a first set of fingers 303 at a similar height as the fingers 303 of the drill pipe racking board 304 and a second set of fingers 303 below the first set of fingers 303. In the example of FIG. 5, the fingers 303 of the drill pipe racking board 302 and the casing racking board 304 face toward each other such that drill pipe 106 and casing 107 may be added to or removed from the racking boards 302, 304 from a common central access area. The fingers 303 "facing each other" may also refer to the fingers 303 extending toward each other in a parallel direction. In other implementations, the fingers 303 of the racking boards 302, 304 face in the same direction (e.g., toward well center 117) or in opposite directions.

A diving board 306 is also shown in FIG. 5 which may be used by an operator to access the racking boards 302, 304. In some implementations, the diving board 306 is movable in a vertical direction, such that an operator may change the position of the diving board to access either of the racking boards 302, 304 comfortably. In other implementations, the drilling rig 100 includes a separate diving board 306 for each of the drill pipe racking board 302 and the casing racking board 304. An operator may access the double layer racking board 102 via one or more ladders 502 and walkways 504 as shown in FIG. 5.

Figure 6:
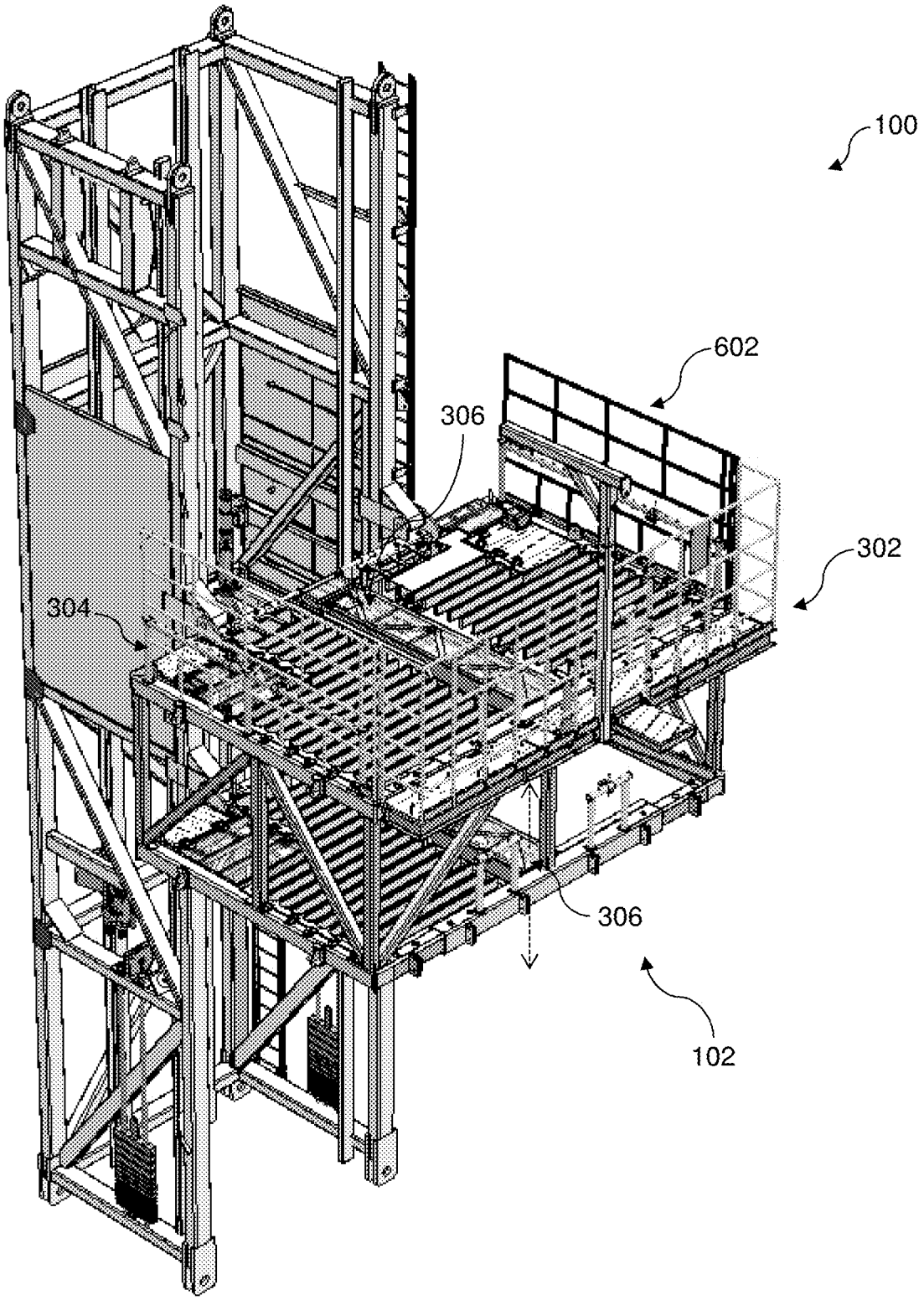
FIG. 6 is another perspective view of the drilling rig according to one or more aspects of the disclosure.

FIG. 6 shows another perspective view of the drilling rig 100 including the double layer racking board 102 without drill pipe 106 or casing 107. The double layer racking board 102 may include railings 602 and other safety features. The double layer racking board may also include features to contain and hold the drill pipe 106 and casing 107.

Figure 7:
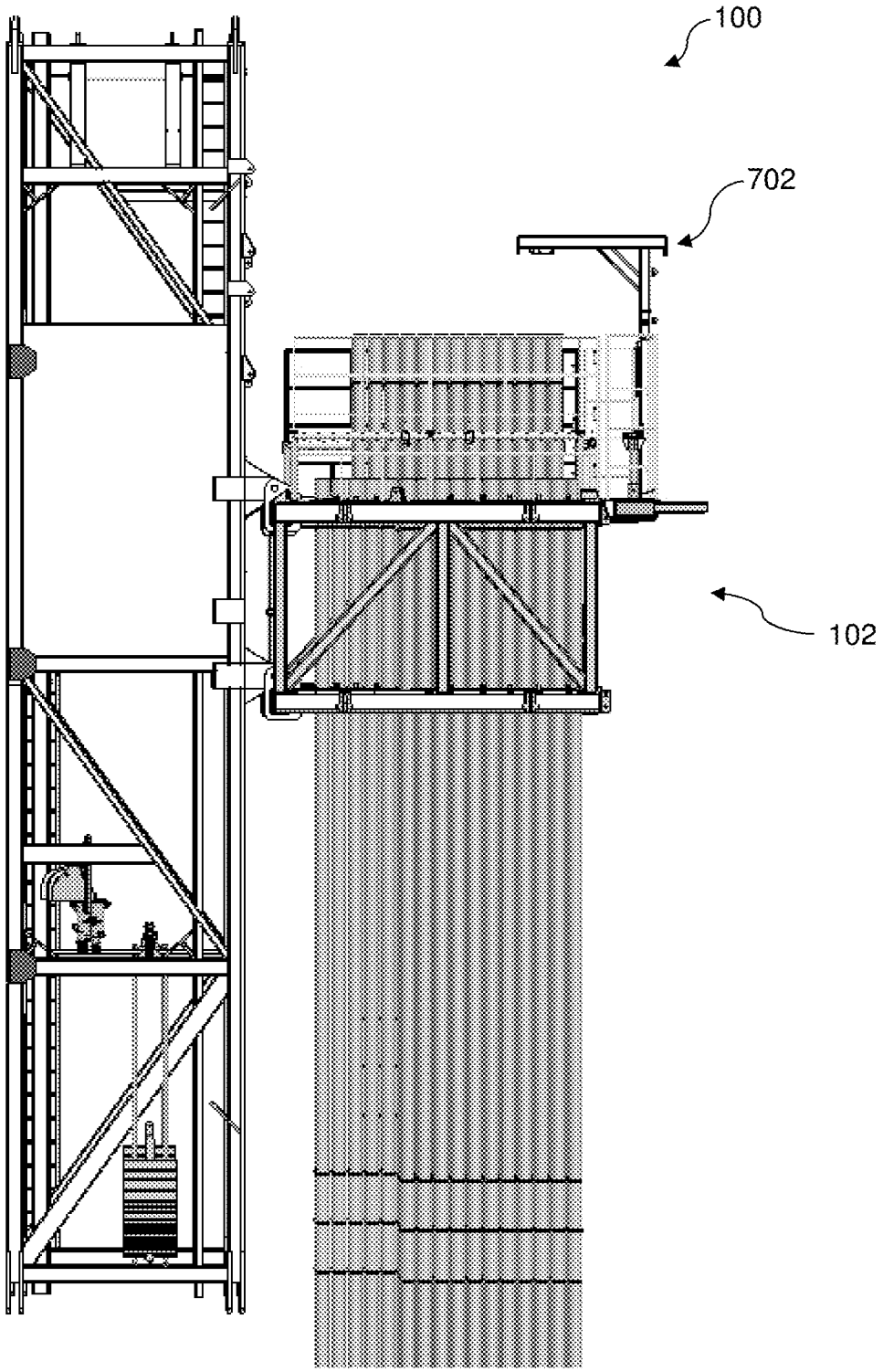
FIG. 7 is side view of the drilling rig according to one or more aspects of the disclosure.

FIG. 7 shows a side view of the drilling rig 100 including the double layer racking board 102. In some implementations, the double layer racking board 102 includes a lift 702 to assist in moving drill pipe 106, casing 107, or components of the double layer racking board 102 (such as the diving board 306). The lift 702 may extend above the double layer racking board 102 and may be accessed by an operator performing assembly or disassembly tasks on the drilling rig 100.

FIGS. 8A-8E illustrate exemplary methods for performing drilling operations with a drilling rig having a dual or double layer racking board such as double layer racking board 102 shown in FIGS. 1-7. In some implementations, the double layer racking board 102 may be used to perform simultaneous casing and drilling operations. For example, a casing operation (e.g., assembling casing) may be performed at the same time as a drilling operation (e.g., tripping out the drill string 104 out of the wellbore 116).

Figure 8A:
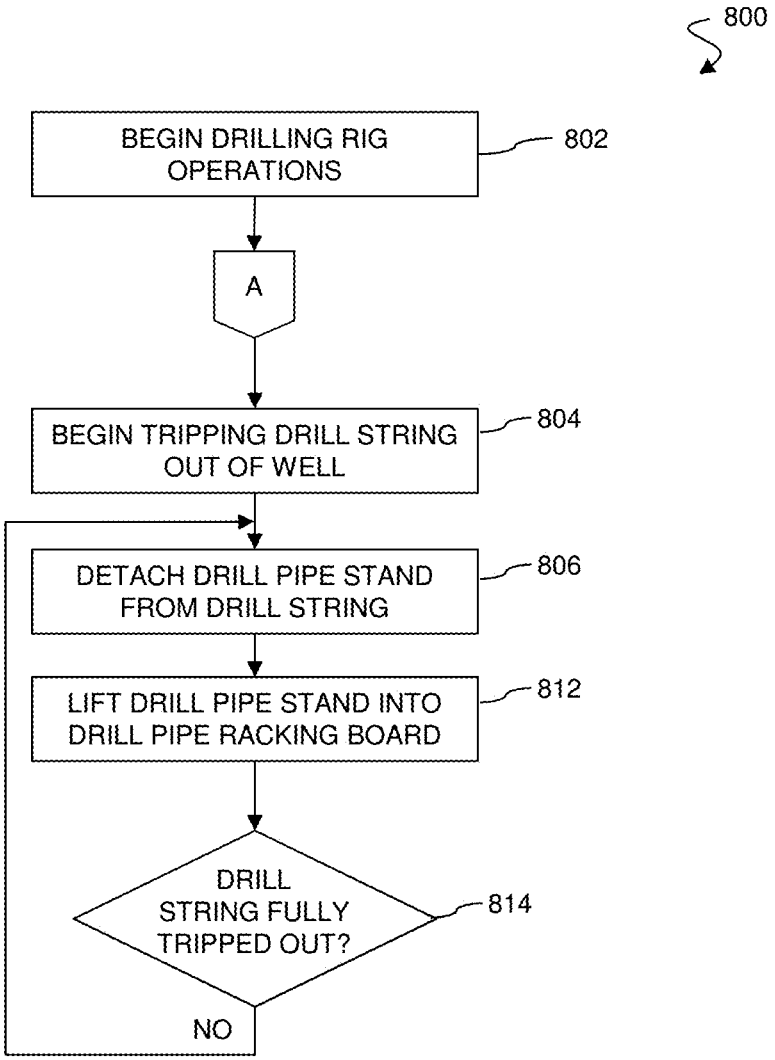
FIG. 8A is a flowchart of an exemplary method for performing drilling operations with a double layer racking board.

With reference to FIG. 8A, the method 800 may begin at step 802 where a decision is made to perform drilling rig operations. Operations A-E may then be performed by the drilling rig. In some implementations, these operations may be performed on the drilling rig at the same time. For example, casing and drilling operations may be performed simultaneously. In this implementation, if casing stands are to be introduced into the wellbore 116, then the casing operation of assembling casing stands may be performed. In other implementations, operations on the drilling rig may be performed at different time.

As shown in FIG. 8A, the method 800 may include operation A starting with step 804, where an operator begins tripping the drill string 104 out of the wellbore 116. At 806, once the drill string 104 has been raised sufficiently to allow workers to detach the uppermost drill pipe stand from the drill string 104. The racking device 305 may lift and carry the drill pipe stand away from well center, and at 812, may rack the drill pipe stand in the drill pipe racking board 302.

At 814, if the drill string 104 is not fully tripped out of wellbore 116, the method 800 returns to step 806, and the method proceeds from that point. In this way, the drill string 104 is disassembled stand by stand until the entire drill string is tripped out of the wellbore 116. In some implementations, other components such as various subs may also be removed from the drill string 104 as they are tripped out of the well using any appropriate means. Furthermore, BHA 110 and drill bit 112 at the end of drill string 104 may be removed as necessary when the end of drill string 104 is tripped out of the wellbore 116. If at 814 the drill string 104 has been fully tripped out of the wellbore 116, the method 800 ends. At this point, another drilling operation may commence.

Figure 8B:
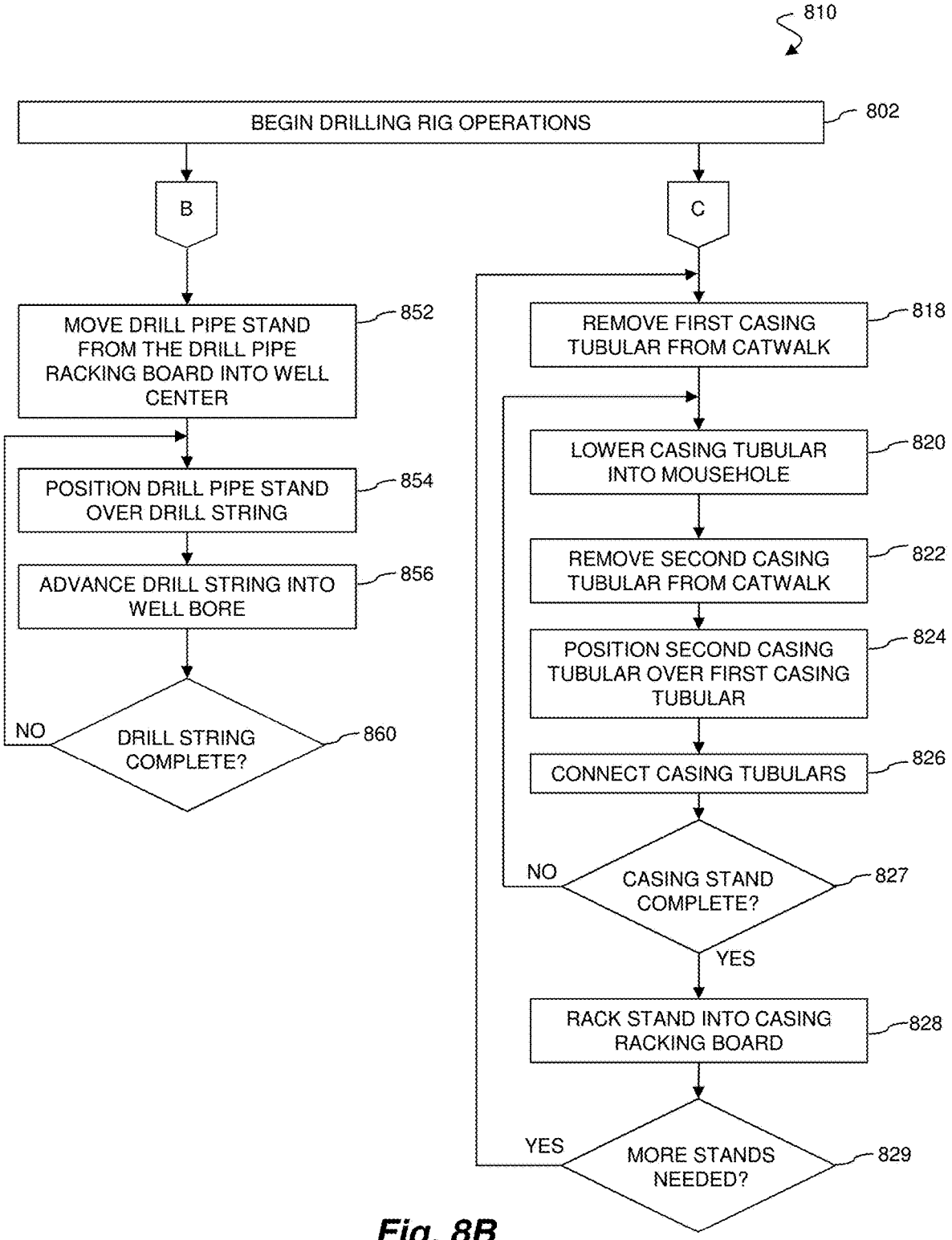
FIG. 8B is a flowchart of an exemplary method for performing drilling operations with a double layer racking board.

FIG. 8B shows method 810 with operations B and C that may be performed at the same time on the drilling rig. In the example shown, the steps of method 810 proceed simultaneously along the left and right sides of the method 810, and advances to steps 852 and 818. For simplicity, the operations of method 810 will be described separately, but at any given time any one of steps 818, 820, 822, 824, 826, 827, 828, 829 may occur simultaneously with any one of steps 852, 854, 856, and 860. It is noted that these processes need not begin at the same point in time. For example, in some implementations, the assembly of casing stands may begin well before the drill string begins to be tripped out of the wellbore 116, and so forth.

Steps 852 begins operation B where it is determined that more drill pipe stands need to be added to drill string 104. A drill pipe stand may be accessed and removed from the drill pipe racking board 302 and moved over well center 117, for example with the use of a racking device as described above.

At 854, the drill pipe stand is positioned over the drill string 104. At 856, the drill pipe stand is connected to the drill string 104. At 858, the drill string 104, now with an added drill pipe stand, is advanced into the wellbore 116.

Moving to decision block 860, if more drill pipe stands need to be added to drill string 104, the method 850 returns to step 854 and proceeds accordingly. If additional drill pipe stands are not needed to be added to the drill string 104, the method 850 ends. At this point, another drilling operation may commence.

Returning to operation C and step 818, when it is determined that casing is needed in wellbore 116, a first casing tubular may be removed from the catwalk. At 820, the first casing tubular may be lowered into the mousehole. In some implementations, equipment such as an automatic racking device may be used to receive the first casing tubular and to move the first casing tubular into the mousehole.

At 822, a second a second casing tubular may be removed from the catwalk. At 824, the second casing tubular may be positioned over the first casing tubular that is already in the mousehole. The casing tubulars may then be connected at 826, for example, with the aid of an iron roughneck.

At 827, if a casing stand has not been completely made-up, the method returns to block 820 and proceeds from that point to provide an additional casing tubular. In this way, a casing stand may be assembled by attaching casing tubulars to each other and lowering the resultant partial casing stand further into the mousehole so that another casing tubular may be added to the top until a casing stand is completed. If at 827 the casing stand has been completed, method 800 progresses to 828.

At 828, the now made-up casing stand is removed, from the mousehole and racked into the casing racking board. In some implementations, this may be done with the aid of a racking device, such as the racking device 305 as shown in FIG. 3A. The racking device may be an automatic racking device as described above.

At 829, if more casing stands are needed, the method returns to block 818 and assembly of another casing stand proceeds from that point. If no more stands are needed, the method 810 ends. Other casing operations may proceed at this point. For example, casing may be introduced to the wellbore 116, for example, if the tripping operation beginning at step 804 has been completed.

Figure 8C:
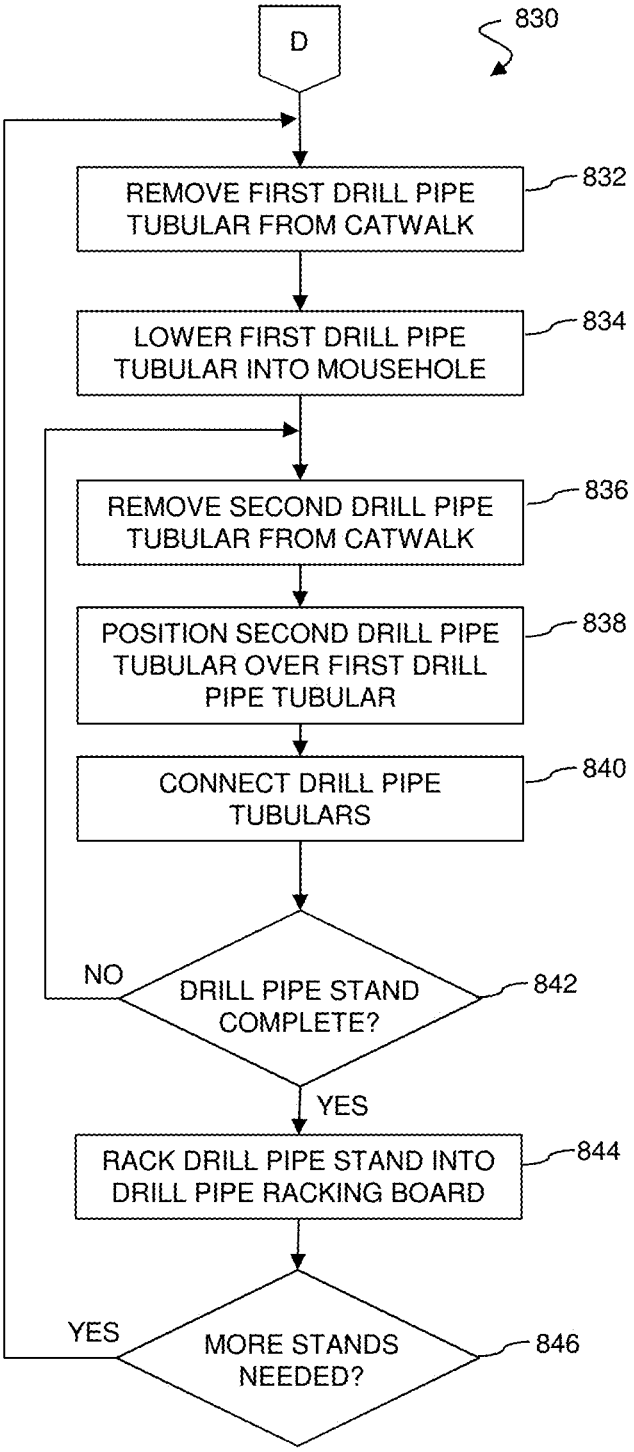
FIG. 8C is a flowchart of an exemplary method for performing drilling operations with a double layer racking board.

FIG. 8C illustrates an exemplary flowchart of a method 830 that may occur as a part of the method in FIG. 8B in place of the tripping out method described at 804, 806, 812, and 814. Accordingly, the method of FIG. 8C may be performed with the casing operations shown in FIG. 8A. The drilling operation shown in FIG. 8C may include assembling drill pipe stands.

Here, the method 830 begins with operation D. When it is determined that more drill pipe stands need to be assembled, a first drill pipe tubular may be removed from the catwalk in step 832. At 834, the first drill pipe tubular is lowered into the mousehole. In some implementations, equipment such as an automatic racking device may be used to move the first drill pipe tubular into the mousehole.

At 836, a second drill pipe tubular may be removed from the catwalk. At 838, the second drill pipe tubular may be positioned over the first drill pipe tubular that is already in the mousehole. The second drill pipe tubular may then be connected to the first drill pipe tubular that is already in the mousehole. At 840, this may be done, for example, with the aid of an iron roughneck.

At 842, if a drill pipe stand has not been completed, the method 830 returns to block 836 and proceeds from that point. In this way, a drill pipe stand may be assembled by attaching drill pipe tubulars to each other and lowering the resultant partial drill pipe stand further into the mousehole so that another drill pipe tubular may be added to the top until a drill pipe stand is completed. If at 840 the drill pipe stand has been completed, method 830 progresses to 842.

At 844, the drill pipe stand may be moved from the mousehole 119 and racked into the drill pipe racking board 302. This may be done, for example, with the aid of a racking device that may be an automatic racking device as described above.

At 846, if more drill pipe stands are needed, the method 830 returns to block 832 and assembly of another drill pipe stand may proceed from that point. If no more stands are needed, the method 830 ends. At this point, another drilling operation may commence.

Figure 8D:
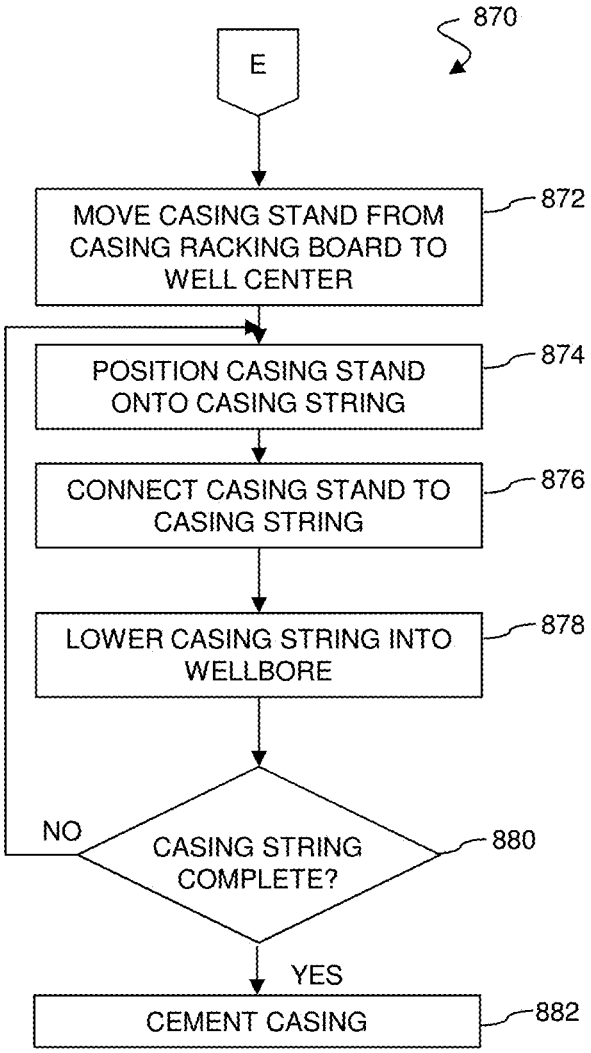
FIG. 8D is a flowchart of an exemplary method for performing drilling operations with a double layer racking board.

FIG. 8D illustrates an exemplary flowchart of a method 870 for performing simultaneous casing and drilling operations using a drilling rig 100 with a double layer racking board 102. In FIG. 8D, only a casing operation is shown, while a drilling operation may happen simultaneously, for example the assembly of drill string stands of FIG. 8B. That is, the casing operation shown in FIG. 8D of introducing casing stands to the wellbore 116 may be performed at the same time as the method of FIG. 8B, of building drill pipe stands (or breaking down drill pipe stands).

The method 870 is an alternative casing operation which may be performed in method 800 in place of assembling casing stands. Accordingly, the method 870 replaces steps 818-829 of FIG. 8B, beginning at operation C.

Beginning from step 802 of method 800 of FIG. 8A, the method 870 moves to step 872 in FIG. 8D. When it is determined that casing needs to be introduced to the wellbore 116, a casing stand may be removed from the casing racking board 304 and moved over well center 117, for example with the use of a racking device as described above.

At 874, the casing stand is positioned onto a casing string. In a casing string does not yet exist, the first casing stand begins the casing string. At 876, the casing stand is connected to the casing string.

At 878, the casing string, now with an added casing stand, is lowered into the wellbore 116.

At 880, if more casing stands need to be added to casing string, the method 870 returns to step 874 and proceeds accordingly. If no more casing stands need to be added to the casing string, the method 870 moves to 882. At 882, once the casing string is cemented into place to provide casing for the wellbore 116. At this point, another casing operation may commence.

Referring now to all of FIGS. 8A-8D, it is noted that other drilling and casing operations may be performed with the systems of FIGS. 1-7, and that various combinations of drilling and casing operations may be performed simultaneously. However, in some implementations, only one drilling or casing operation may occur over well center 117 at any given time.

In view of all of the above and the figures, one of ordinary skill in the art will readily recognize that the present disclosure introduces a land-based drilling apparatus, including: a drill floor including a well center bore and a mousehole; a mast extending above the drill floor; a double layer racking board connected to the mast, the double layer racking board comprising: a drill pipe racking board including a first plurality of fingers and configured to receive drill pipe tubulars, wherein the drill pipe racking board is disposed at a first height with respect to the drill floor; and a casing racking board including a second plurality of fingers and configured to receive casing tubulars, wherein the casing racking board is disposed at a second height with respect to the drill floor, wherein the first height is greater than the second height.

In some implementations, the drilling apparatus further includes a diving board disposed between the drill pipe racking board and the casing racking board. The diving board may be movable in a vertical direction such that the diving board provides access the drill pipe racking board and the casing racking board. The drilling apparatus may also include a first diving board connected to the drill pipe racking board and a second diving board connected to the casing racking board. The drill pipe racking board may be directly connected to the casing racking board.

In some implementations, the drill pipe racking board and the casing racking board are cantilevered, such an end of the drill pipe racking board and an end of the casing racking board are connected to the mast. The drill pipe racking board and the casing racking board may be independently connected to the mast. The first height of the drill pipe racking board may be between 86 and 90 feet. The second height of the casing racking board may be between 81 and 88 feet. In some implementations, the drill pipe racking board is configured to receive drill pipe stands comprising three drill pipe tubulars, wherein the casing racking board is configured to receive casing stands comprising two casing tubulars.

A method is also provided, which may include: performing a first drilling operation on a land-based drilling rig by introducing or removing drill pipe stands from a wellbore; and performing a second drilling operation on the land-based drilling rig at a same time as the first drilling operation, the second drilling operation comprising introducing or removing casing stands from a casing racking board of the drilling rig, the casing racking board having a first height less than the height of a drill pipe racking board on the land-based drilling rig with respect to a drill floor of the drilling rig.

In some implementations, the first drilling operation is one of tripping in, tripping out, or drilling. The tripping out may include: removing a portion of the drill string from a well bore; removing a plurality of drill pipe stands from the drill string; and introducing the drill pipe stands to the drill pipe racking board. In some implementations, the second drilling operation is one of casing stand make up, casing stand breakdown, or introducing casing stands to well center bore. The casing stand make up may include: introducing a first casing tubular into a mousehole on the drill floor of the drilling rig; positioning a second casing tubular over the first casing tubular; connecting the first and second casing tubulars to form a casing stand; and introducing the casing stand to the casing racking board of the drilling rig.

A double layer racking board of a land-based drilling rig is also provided, including: a drill pipe racking board connected to a mast of the drilling rig, the drill pipe racking board comprising a first plurality of fingers spaced to receive a plurality of drill pipe stands; and a casing racking board connected to the mast of the drilling rig, the casing racking board comprising a second plurality of fingers spaced to receive a plurality of casing stands, wherein the drill pipe racking board is positioned at a first height with respect to a drill floor of the drilling rig, wherein the casing racking board is disposed at a second height with respect to the drill floor, wherein the first height is greater than the second height.

In some implementations, the first plurality of fingers faces the second plurality of fingers. The double layer racking board may further include a diving board disposed between the drill pipe racking board and the casing racking board. The drill pipe racking board and the casing racking board may be cantilevered, such an end of the drill pipe racking board and an end of the casing racking board are connected to the mast. The drill pipe racking board and the casing racking board may be independently connected to the mast.

The foregoing outlines features of several implementations so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the implementations introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A land-based drilling apparatus, comprising:

a drill floor including a well center bore and a mousehole;

a mast extending above the drill floor;

a double layer racking board connected to the mast, the double layer racking board comprising:

a drill pipe racking board including a first plurality of fingers and configured to receive drill pipe tubulars, wherein the drill pipe racking board is disposed at a first height with respect to the drill floor to define a first level of the double layer racking board; and a casing racking board including a second plurality of fingers and configured to receive casing tubulars, wherein a first portion of the casing racking board is disposed at the first height with respect to the drill floor, wherein a second portion of the casing racking board is disposed at a second height with respect to the drill floor to define a second level of the double layer racking board, wherein the first height is greater than the second height, such that the drill pipe racking board and the first portion of the casing racking board define the first level of the double layer racking board above the second level of the double layer racking board.

2. The apparatus of claim 1, further comprising a diving board disposed between the drill pipe racking board and the casing racking board.

3. The apparatus of claim 2, wherein the diving board is movable in a vertical direction such that the diving board provides access the drill pipe racking board and the casing racking board.

4. The apparatus of claim 1, further comprising a first diving board connected to the drill pipe racking board and a second diving board connected to the casing racking board.

5. The apparatus of claim 1, wherein the drill pipe racking board is directly connected to the casing racking board.

6. The apparatus of claim 1, wherein the drill pipe racking board and the casing racking board are cantilevered, such an end of the drill pipe racking board and an end of the casing racking board are connected to the mast.

7. The apparatus of claim 1, wherein the drill pipe racking board and the casing racking board are independently connected to the mast.

8. The apparatus of claim 1, wherein the first height of the drill pipe racking board is between 86 and 90 feet.

9. The apparatus of claim 1, wherein the second height of the casing racking board is between 81 and 88 feet.

10. The apparatus of claim 1, wherein the drill pipe racking board is configured to receive drill pipe stands comprising three drill pipe tubulars, wherein the casing racking board is configured to receive casing stands comprising two casing tubulars.

11. A method, comprising:

performing a first drilling operation on a land-based drilling rig by introducing or removing drill pipe stands from a wellbore; and performing a second drilling operation on the land-based drilling rig at a same time as the first drilling operation, the second drilling operation comprising introducing or removing casing stands from a casing racking board of the drilling rig, the casing racking board having a first portion disposed at a first height and a second portion disposed at a second height with respect to a drill floor of the drilling rig, wherein the first portion of the casing racking board and a drill pipe racking board on the land-based drilling rig define a first level within a double layer racking board, wherein the second portion of the casing racking board defines a second level beneath the first level with respect to the drill floor.

12. The method of claim 11, wherein the first drilling operation is one of tripping in, tripping out, or drilling.

13. The method of claim 12, wherein the tripping out comprises:

removing a portion of a drill string from a well bore;

removing a plurality of drill pipe stands from the drill string; and introducing the drill pipe stands to the drill pipe racking board.

14. The method of claim 11, wherein the second drilling operation is one of casing stand make up, casing stand breakdown, or introducing casing stands to well center bore.

15. The method of claim 14, wherein the casing stand make up comprises:

introducing a first casing tubular into a mousehole on the drill floor of the drilling rig;

positioning a second casing tubular over the first casing tubular;

connecting the first and second casing tubulars to form a casing stand; and introducing the casing stand to the casing racking board of the drilling rig.

16. A double layer racking board of a land-based drilling rig, comprising:

a drill pipe racking board connected to a mast of the drilling rig, the drill pipe racking board comprising a first plurality of fingers spaced to receive a plurality of drill pipe stands; and a casing racking board connected to the mast of the drilling rig and comprising a first portion and a second portion, the first portion of the casing racking board comprising a second plurality of fingers spaced to receive a plurality of casing stands, wherein the drill pipe racking board is positioned at a first height with respect to a drill floor of the drilling rig, wherein the second portion of the casing racking board is disposed at a second height with respect to the drill floor, wherein the first height is greater than the second height, wherein the drill pipe racking board and the first portion of the casing racking board define a first level of the double layer racking board, wherein the second portion of the casing racking board defines a second level of the double layer racking board.

17. The double layer racking board of claim 16, wherein the first plurality of fingers faces the second plurality of fingers.

18. The double layer racking board of claim 16, further comprising a diving board disposed between the drill pipe racking board and the casing racking board.

19. The double layer racking board of claim 16, wherein the drill pipe racking board and the casing racking board are cantilevered, such an end of the drill pipe racking board and an end of the casing racking board are connected to the mast.

20. The double layer racking board of claim 16, wherein the drill pipe racking board and the casing racking board are independently connected to the mast.

* * * * *